US007613417B2

(12) United States Patent
Fujishima et al.

(10) Patent No.: US 7,613,417 B2
(45) Date of Patent: Nov. 3, 2009

(54) IMAGE FORMING APPARATUS

(75) Inventors: Masashi Fujishima, Osaka (JP); Shoichi Sakata, Osaka (JP); Kiyotaka Kobayashi, Osaka (JP); Yukihiro Mori, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/142,194

(22) Filed: Jun. 19, 2008

(65) Prior Publication Data

US 2009/0003891 A1 Jan. 1, 2009

(30) Foreign Application Priority Data

Jun. 27, 2007 (JP) ..... 2007-168831
Apr. 22, 2008 (JP) ..... 2008-111694

(51) Int. Cl.
*G03G 15/09* (2006.01)

(52) U.S. Cl. ..... 399/270; 399/282; 399/285

(58) Field of Classification Search ..... 399/55, 399/270, 272, 274, 281, 282, 284, 285
See application file for complete search history.

(56) References Cited

U.S. PATENT DOCUMENTS 3,929,098 A 12/1975 Liebman
4,686,934 A * 8/1987 Kohyama ..... 399/282
5,247,333 A * 9/1993 Yamamoto et al. ..... 399/273
6,463,244 B2 10/2002 Aoki et al.
6,999,691 B2 * 2/2006 Lee ..... 399/55

FOREIGN PATENT DOCUMENTS

| | | |
|---|---|---|
| JP | 2001-134050 | 5/2001 |
| JP | 2001-272857 | 10/2001 |
| JP | 2003-21961 | 1/2003 |
| JP | 2003-21966 | 1/2003 |
| JP | 2003-280357 | 10/2003 |
| JP | 2005-242281 | 9/2005 |

* cited by examiner

*Primary Examiner*—David M Gray
*Assistant Examiner*—Barnabas T Fekete
(74) *Attorney, Agent, or Firm*—Gerald E. Hespos; Anthony J. Casella

(57) ABSTRACT

An image forming apparatus uses a two-component developer containing a toner and a carrier. The apparatus has a latent image bearer for bearing an electrostatic latent image. A toner bearer bears the toner to be conveyed to a development region to develop the electrostatic latent image. A developer bearer bears the two-component developer and supplies the toner to the toner bearer. A regulator sets the thickness of a toner layer carried on the toner bearer to 6 μm to 15 μm and sets a difference between a half width of a first toner charge number distribution as a number distribution of the charge amount of the toner carried on the toner bearer and that of a second toner charge number distribution as a number distribution of the charge amount of the toner in the two-component developer carried on the developer bearer to 0.8 ($10^{-10}$ C/m) or smaller.

7 Claims, 10 Drawing Sheets

FIG.5

| | HALF WIDTH [$10^{-10}$C/m] | | PEAK POSITION [$10^{-10}$C/m] | | THIN TONER LAYER THICKNESS [μm] | DEVELOPING ROLLER SURFACE PROCESSING | Duty(slv) [%] | Duty(mag) [%] | IMAGE NONUNIFORMITY A | IMAGE DENSITY ID (AFTER 1000 PRINTS) | GHOST |
|---|---|---|---|---|---|---|---|---|---|---|---|
| | DEVELOPING ROLLER | MAGNETIC ROLLER | DEVELOPING ROLLER | MAGNETIC ROLLER | | | | | | | |
| EXAMPLE1 | 3.2 | 3.1 | 3.20 | 3.10 | 12.5 | SILICON MODIFIED URETHANE COATING | 30 | 70 | 0.115 | 1.412 | GOOD |
| EXAMPLE2 | 3.4 | 3.5 | 2.40 | 2.80 | 14.5 | ALUMITE PROCESSING | 50 | 65 | 0.120 | 1.425 | GOOD |
| EXAMPLE3 | 2.8 | 3.5 | 2.25 | 2.80 | 15.0 | ALUMITE PROCESSING | 35 | 70 | 0.145 | 1.364 | SATISFACTORY |
| EXAMPLE4 | 2.9 | 3.4 | 2.80 | 3.00 | 15.0 | SILICON MODIFIED URETHANE COATING | 30 | 70 | 0.118 | 1.400 | GOOD |
| EXAMPLE5 | 3.1 | 3.2 | 3.10 | 3.20 | 6.0 | SILICON MODIFIED URETHANE COATING | 30 | 50 | 0.118 | 1.348 | GOOD |
| EXAMPLE6 | 3.2 | 3.1 | 3.20 | 3.10 | 12.5 | SILICON MODIFIED URETHANE COATING | 50 | 60 | 0.111 | 1.440 | GOOD |
| EXAMPLE7 | 2.8 | 3.5 | 2.30 | 2.80 | 15.0 | NONE | 50 | 70 | 0.146 | 1.362 | SATISFACTORY |
| EXAMPLE8 | 2.8 | 3.5 | 1.80 | 2.80 | 15.0 | NONE | 60 | 70 | 0.132 | 1.335 | SATISFACTORY |
| COMPARATIVE EXAMPLE1 | 2.6 | 3.5 | 1.95 | 2.80 | 15.0 | NONE | 30 | 70 | (0.165) | (1.296) | IMPERMISSIBLE |
| COMPARATIVE EXAMPLE2 | 2.4 | 3.5 | 1.75 | 2.80 | 16.0 | NONE | 30 | 75 | (0.186) | (1.273) | IMPERMISSIBLE |
| COMPARATIVE EXAMPLE3 | 3.2 | 3.1 | 3.20 | 3.10 | 5.8 | SILICON MODIFIED URETHANE COATING | 30 | 45 | 0.115 | (1.298) | GOOD |
| COMPARATIVE EXAMPLE4 | 2.6 | 3.5 | 2.40 | 2.80 | 16.0 | SILICON MODIFIED URETHANE COATING | 30 | 80 | (0.152) | 1.351 | IMPERMISSIBLE |

IMAGE FORMING APPARATUS

BACKGROUND OF THE INVENTION

1. Field of the Invention

The present invention relates to an electrophotographic image forming apparatus such as a copier, a printer, a facsimile machine or a complex machine and particularly to an image forming apparatus employing a non-contact developing method for developing an electrostatic latent image using a two-component developer, in which a nonmagnetic toner is charged by a magnetic carrier, by holding only the charged toner on a developing roller and transferring the toner toward the electrostatic latent image.

2. Description of the Related Art

Conventionally, development by a non-contact developing method with the use of a one-component developer has been considered for image forming apparatuses such as copiers, printers, facsimile machine and complex machines. In recent years, with the speeding up of printing, consideration has been made about image development for a high-speed image forming method, particularly image development for a one-drum color superimposing method for successively forming a plurality of color images on a photoconductor. By this one-drum color superimposing method, color image formation with less color drift is possible by accurately superimposing toners on the photoconductor, and this method is attracting attention as technology for coping with higher quality of color images.

Recently, attention has been drawn to a so-called tandem method for forming color images in synchronism with the feed of a transfer member and superimposing them on the transfer member using a plurality of photoconductors corresponding to the respective colors of toners. This method has an advantage of being fast, but has a disadvantage of enlarging the apparatus since electrophotographic processing members (image forming units) of the respective colors have to be arranged side by side. In view of this disadvantage, there has been proposed a small-size tandem image forming apparatus in which image forming units miniaturized by narrowing intervals between photoconductors are arranged.

Concerning this tandem image forming apparatus, technology for image development by supplying a developer to a donor roller (developing roller) by means of a magnetic roller and causing the toner to transfer to the donor roller to form a toner layer is disclosed, for example, in patent literature 1 (U.S. Pat. No. 3,929,098). However, with this technology, the charge control of the toner is complicated and a high surface potential and a large developing electric field need to be applied to the photoconductor.

Further, since it is difficult to remove the toner on the donor roller unused for image development, if a toner consumed region and a toner nonconsumed region are formed on the donor roller, an adhering state of the toner and a potential difference of the toner on this donor roller vary. Thus, there is a problem of the occurrence of a phenomenon in which part of a previously developed image appears as a residual image (ghost) during the next image development, so-called a history phenomenon.

In view of this problem, technology is disclosed, for example, in patent literature 2 (Japanese Unexamined Patent Publication No. 2003-21961) and patent literature 3 (Japanese Unexamined Patent Publication No. 2003-21966) according to which a magnetic roller (magnetic brush roller) for holding a magnetic brush formed using a two-component developer containing a carrier and a toner by a magnetic member fixed inside, a developing roller for forming a toner layer by contact with the magnetic brush and a power supply for forming an alternating electric field between the developing roller and a photoconductor are provided, and a latent image on the photoconductor is developed with the toner transferred from the toner layer by the alternating electric field to prevent the occurrence of a residual image (ghost) during image development while avoiding the occurrence of fogging.

Further, patent literature 4 (Japanese Unexamined Patent Publication No. 2001-134050) discloses technology in a developing device using a one-component developer, including a developing roller held in contact with a photoconductor and a supply roller held in contact with this developing roller, and adapted to supply a toner to the developing roller by means of the supply roller and to form a thin layer of the toner frictionally charged by a restricting blade to develop a latent image on the photoconductor, wherein an alternating voltage is also applied to the supply roller and the both alternating voltages are set to have the same frequency, but different phases.

According to this technology, if a developing electric field applied to the developing roller is an alternating-current electric field in light of preventing a problem that low density images and thin line images are difficult to develop or the occurrence of density nonuniformity caused by an increase of a toner charge amount, low density images and thin line images can be satisfactorily developed and the toner unused for image development can be easily scraped off. However, fogging occurs if an alternating voltage is too high, whereas the effect of pulling back the toner unused for image development is reduced if the alternating voltage is low. This technology seeks to solve this problem.

Further, in order to solve the above problem, patent literature 5 (Japanese Unexamined Patent Publication No. 2005-242281) discloses technology in a developing device in which a toner layer is formed on a developing roller by contact with a magnetic brush formed of a two-component developer and toner is transferred from the developing roller by an alternating electric field of a rectangular wave generated between the developing roller and a photoconductor by a first power supply, thereby developing a latent image on the photoconductor, wherein an alternating electric field of a rectangular wave having the same frequently as, an opposite phase to and an inverted duty ratio of the one generated by the first power supply is applied between a magnetic roller and the developing roller by a second power supply.

However, with the above respective technologies, if Vslv and Vmag denote, for example, a bias voltage (alternating-current bias) to be applied to the developing roller and a bias voltage to be applied to the magnetic roller (magnetic brush), a power supply construction for applying the bias voltages is such that the bias voltages Vslv, Vmag are applied to a developing roller 901 and a magnetic roller 902 respectively by first and second bias power supplies 911, 912 (respective power supplies are individually grounded), for example, as shown in FIG. 6. Thus, a potential difference between the magnetic roller 902 and the developing roller 901 can be obtained as a difference between the bias voltages Vslv and Vmag.

In consideration of the balance of the releasability of toner on the developing roller unused for image development, toner thin layer formation and toner developability between the magnetic roller and the developing roller, optimal alternating bias voltages applied between the magnetic roller and the developing roller are, for example, in the above example such that the bias voltage Vslv applied to the developing roller 901 has a duty ratio of 10 to 30%, a frequency of 4 kHz and a Vpp of 1.6 kV and the bias voltage Vmag applied to the magnetic roller 902 has a duty ratio of 70 to 90%, a frequency of 4 kHz and a Vpp of 0.3 kV.

In the following description, duty ratios are all expressed in percent (%).

However, as the toner particle diameter is decreased for faster image development and higher image quality, a range for maintaining the above balance becomes narrower. Thus, if durability is also considered, it is difficult to ensure optimal values.

Since the potential difference between the magnetic roller and the developing roller is obtained as the difference between the bias voltages Vslv and Vmag as described above, it cannot be directly set, wherefore the potential difference between the magnetic roller and the developing roller needs to be controlled to a desired potential difference by balancing the respective output voltages of the first and second bias power supplies 911, 912.

Since the respective output voltages of the first and second bias power supplies 911, 912 relate to controls of the releasability of toner on the developing roller unused for image development, the toner thin layer formation and the toner developability between the magnetic roller and the developing roller, it is not easy to set the potential difference between the magnetic roller and the developing roller to a desired potential difference while balancing voltages suitable for these controls and the potential difference between the magnetic roller and the developing roller.

For example, patent literature 6 (Japanese Unexamined Patent Publication No. 2003-280357) discloses technology for applying an alternating bias voltage having a duty ratio of 10 to 50% to a developing roller. This technology is for applying the alternating bias voltage only to the developing roller without applying it to a magnetic roller. Particularly, the duty ratios of the alternating bias voltages applied to the magnetic roller and the developing roller are not mentioned at all in patent literature 6.

Further, in this developing method (touch-down developing method: processing by a two-component method up to the magnetic roller and, then, image development is performed by a one-component method for forming a toner thin layer on the developing roller by toner from the magnetic roller and transferring the toner), the toner thin layer is selectively (preferentially) formed by toner particles easier to transfer upon forming the thin toner layer on the developing roller by the transfer of toner particles from the magnetic roller and a charge number distribution of the toner (toner particle distribution) in the two-component developer largely varies between at the start of printing and after repeated print outputs, wherefore problems such as image density defects, fogging and toner scattering occur and it is difficult to maintain stable performances over a long term.

Concerning this, technology for developing an image such that the charge number distribution of toner on a developing roller and that of toner in a developer on a magnetic roller differ is, for example, disclosed in patent literature 7 (Japanese Unexamined Patent Publication No. 2001-272857).

However, that the charge number distributions of the toners on the developing roller and on the magnetic roller differ indicates that toner particles with a specific charge in the two-component developer on the magnetic roller selectively transfer to the developing roller. Specifically, if the toner particles are selectively transferred, the toner charge distribution in the two-component developer broadens, wherefore it becomes difficult to stably form the thin toner layer (image forming operation; printing operation) on the developing roller over a long term.

SUMMARY OF THE INVENTION

An object of the present invention is to provide an image forming apparatus capable of maintaining stable performances over a long term by suppressing image density defects, fogging, toner scattering, ghost phenomenon and the like.

One aspect of the present invention is directed to an image forming apparatus using a two-component developer containing a toner and a carrier, comprising a latent image bearing member for bearing an electrostatic latent image; a toner bearing member opposed to the latent image bearing member and adapted to bear the toner to be conveyed to a development region to develop the electrostatic latent image; a developer bearing member opposed to the toner bearing member and adapted to bear the two-component developer and supply the toner in the two-component developer to the toner bearing member; and a regulator for setting the thickness of a toner layer carried on the toner bearing member to 6 μm to 15 μm and setting a difference between a half width of a first toner charge number distribution as a number distribution of the charge amount of the toner carried on the toner bearing member and that of a second toner charge number distribution as a number distribution of the charge amount of the toner in the two-component developer carried on the developer bearing member to 0.8 ($10^{-10}$ C/m) or smaller.

According to this construction, the image forming apparatus comprises the latent image bearing member for bearing an electrostatic latent image, the toner bearing member opposed to the latent image bearing member and adapted to bear the toner to be conveyed to a development region to develop the electrostatic latent image, the developer bearing member opposed to the toner bearing member and adapted to bear the two-component developer and supply the toner in the two-component developer to the toner bearing member and the regulator, and the difference between the half width of the first toner charge number distribution as a number distribution of the charge amount of the toner carried on the toner bearing member and that of the second toner charge number distribution as a number distribution of the charge amount of the toner in the two-component developer carried on the developer bearing member is set to 0.8 ($10^{-10}$ C/m) or smaller by the regulator. Further, the thickness of the toner layer carried on the toner bearing member is set to 6 μm to 15 μm.

Since the toner layer thickness is set to a small value of 6 μm to 15 μm in this way, the toner on the toner bearing member can be entirely (as much as possible) used for image development. Further, since the half width difference is as small as 0.8 ($10^{-10}$ C/m) or smaller, the difference (deviation) between the charge number distribution of the toner in the thin toner layer on the toner bearing member and that of the toner in the two-component developer on the developer bearing member can be reduced (so that the two charge number distributions coincide), and the selectivity of the toner transfer between the toner bearing member and the developer bearing member (or between the developer bearing member and the latent image bearing member) can be reduced. Because of these, stable performances can be maintained over a long term by suppressing image density defects, fogging, toner scattering, ghost phenomenon and the like.

These and other objects, features, aspects and advantages of the present invention will become more apparent upon a reading of the following detailed description and accompanying drawings.

BRIEF DESCRIPTION OF THE DRAWINGS

FIG. 5 is a table showing operation results of printers according to the first to third embodiments.

DETAILED DESCRIPTION OF THE PREFERRED EMBODIMENTS

First Embodiment

Figure 1:
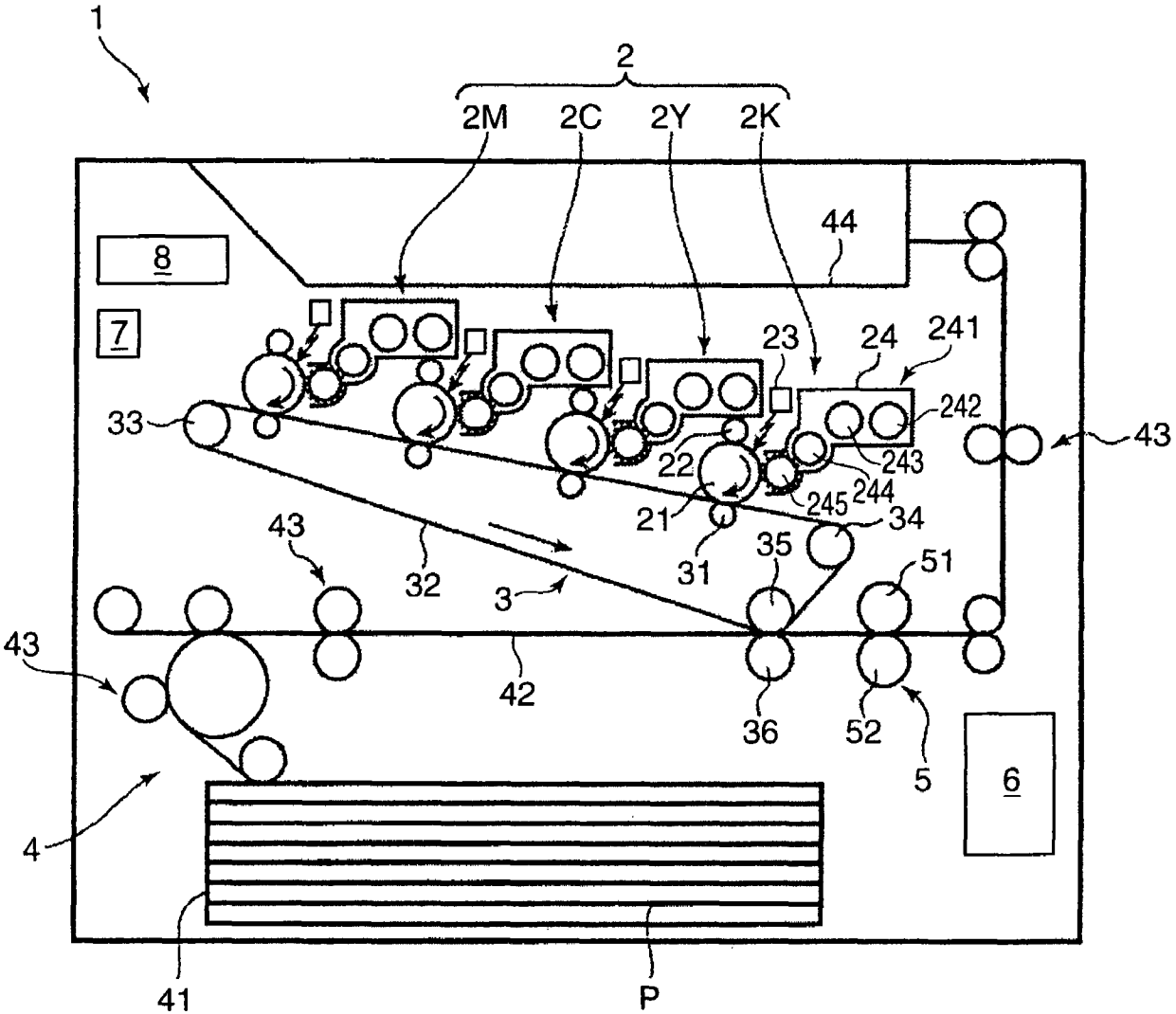
FIG. 1 is a schematic construction diagram of a printer as an example of an image forming apparatus according to a first embodiment.

Hereinafter, printers as examples of an image forming apparatus according to the present invention are described with reference to the accompanying drawings. FIG. 1 is a schematic construction diagram of an example of a printer according to a first embodiment. As shown in FIG. 1, the printer 1 is a so-called tandem image forming apparatus and image forming units 2M, 2C, 2Y and 2K of different colors, i.e. magenta (M), cyan (C), yellow (Y) and black (K) are arranged side by side in a printer main body.

The image forming units 2M, 2C, 2Y and 2K (an assembly of these is called an "image forming assembly 2") are for forming (printing) a color image on a sheet and are each provided with a photoconductive drum 21 (latent image bearing member) made of, for example, amorphous silicon (a-Si), a charger 22, an exposing device 23 and a developing device 24 arranged around this photoconductive drum 21.

The charger 22 uniformly charges the outer surface of the photoconductive drum 21 to a specified potential. The exposure device 23 irradiates the outer surface of the photoconductive drum 21 with a laser beam (LED light) based on an image data to form an electrostatic latent image on the photoconductive drum 21. The developing device 24 supplies and attaches a toner to the electrostatic latent image formed on the photoconductive drum 21, thereby developing the electrostatic latent image as a toner image. In this embodiment, the construction of this developing device 24 (and the photoconductive drum 21) has a main feature point, which is described in detail later.

An intermediate transfer unit 3 including intermediate transfer rollers 31 (primary transfer rollers) and an intermediate belt (intermediate transfer belt) 32 for the intermediate transfer of toner images developed on the outer surfaces of the photoconductive drums 21 is arranged below the image forming units 2M to 2K. The intermediate belt 32 is made of a specified belt body and endlessly rotated by drive rollers 33 to 35 while being pressed against the photoconductive drums 21 by the intermediate transfer rollers 31 arranged to face the photoconductive drum 21 of the respective colors. The toner images of the respective colors formed on the photoconductive drums 21 are transferred to the endlessly rotated intermediate belt 32 in the order of magenta, cyan, yellow and black to be superimposed while being timed with the movement of the intermediate belt 32. In this way, a color image of four colors, i.e. Y, M, C and K is formed on the intermediate belt 32.

A secondary transfer roller 36 is disposed at a position to face the drive roller 35 via the intermediate belt 32 (the secondary transfer roller 36 is included in the intermediate transfer unit 3). The secondary transfer roller 36 is for transferring the color image on the intermediate belt 32 to a sheet upon receiving a transfer bias voltage from a controller 6 to be described later.

The printer 1 is also provided with a sheet feeding unit 4 for feeding sheets toward the image forming units 2Y to 2K. The sheet feeding unit 4 includes a sheet cassette 41 for accommodating sheets P of different sizes, a conveyance path 42 as a path in which the sheet P is conveyed, conveying rollers 43 for conveying the sheet P in the conveyance path 42 and the like, and conveys the sheets P dispensed one by one from the sheet cassette 41 toward the image forming units 2Y to 2K, i.e. toward the position of the secondary transfer roller 36. A fixing device 5 is provided at a suitable position on the conveyance path 42 downstream of the secondary transfer roller 36. The fixing device 5 is for fixing a toner image transferred to a sheet P. The fixing device 5 includes a heat roller 51 and a pressure roller 52, wherein the toner on the sheet is melted by the heat of the heat roller 51 and the melted toner is pressed by the pressure roller 52 to be fixed to the sheet P. The sheet feeding unit 4 conveys the sheet P after the secondary transfer process to the fixing device 5 and discharges the sheet P after the fixing process to a sheet discharge tray in an upper part of the printer main body.

The printer 1 is also provided with the controller 6 at a suitable internal position. The controller 6 includes a ROM (Read Only Memory) storing various control programs, a RAM (Random Access Memory) for temporarily saving data and functioning as a work area and a microcomputer for reading the control program and the like from the ROM and implementing it, and performs the operation control of the entire printer 1 by transmitting and receiving various control signals to and from the respective functional portions of the printer 1. In this embodiment, the controller 6 particularly controls the driving of a first bias power supply 246 (regulator, second bias applying device) and a second bias power supply 247 (regulator, first bias applying device) shown in FIG. 2 to be described later to control the application of bias voltages (cycles, phases, Vpp, frequencies and duty ratios) to a magnetic roller 244 (developer bearing member) and a developing roller 245 (toner bearing member).

The printer 1 is further provided with a network interface (I/F) 7 for controlling the transmission and reception of various data to and from an information processor (external apparatus) such as a PC connected via a network such as a LAN, an operation panel unit 8 provided, for example, on the front side of the printer 1 for functioning as input keys used by a user to input various instructions and displaying specified information, and the like.

Here, the developing device 24 is described in detail. The developing device 24 includes a developer container 241, an agitation mixer 242, a paddle mixer 243, the magnetic roller 244 and the developing roller 245. The developer container 241 is, for example, a cartridge-type container for containing a developer (toner) of the corresponding color. The agitation mixer 242 is for agitating the developer supplied from the developer container 241. The paddle mixer 243 agitates the developer and collects the developer by scraping off a magnetic brush collecting the residual toner on the developing roller 245, which was not used for image development.

The magnetic roller 244 forms a magnetic brush by a carrier contained in the developer by a magnet arranges inside to form a thin toner layer on the developing roller 245. The developing roller 245 is for developing an electrostatic latent image on the photoconductive drum 21 by bearing the thin toner layer.

In this embodiment, a so-called two-component developer containing the toner and the carrier is employed as the developer. The toner is fine particles which have a particle diameter of, e.g. 6 to 12 μm and in which additives such as a colorant, a charge control agent, wax and the like are dispersed in a binder resin. Here, a positively chargeable toner is employed. On the other hand, the carrier is magnetic particles of a magnetite ($Fe_3O_4$) having a particle diameter of, e.g. 60 to 200 μm and is used to charge the toner. The carrier functions to collect and supply the toner. A carrier having a volume resistivity of $10^6$ to $10^{13}$ Ωcm is, for example, used.

The firmly electrostatically attached toner is released and the toner necessary for image development is supplied by the magnetic brush in a nip between the developing roller 245 and the magnetic roller 244. At this time, in order to increase contact points with the toner, it is preferable to increase the surface area of the carrier by using the carrier having a diameter equal to or smaller than 50 μm. Here, a coating ferrite carrier having a volume resistivity of $10^{10}$ Ωcm, a saturation magnetization of 65 emu/g and an average particle diameter of 45 μm.

The two-component developer in the developing device 24 forms the magnetic brush containing the toner and the carrier on the magnetic roller 244. This toner is agitated by the agitation mixer 242 to be charged to a proper level. The magnetic brush is formed on the magnetic roller 244 by this two-component developer and comes into contact with the developing roller 245 while having a specified layer thickness by having the layer thickness restricted by a restricting blade (not shown), and a thin layer made up only of the toner is formed on the developing roller 245 from the magnetic brush by a potential difference |DC1−DC2| between the magnetic roller 244 and the developing roller 245 (this potential difference is expressed by ΔV).

In this way, the thickness of the toner layer carried on the outer surface of the developing roller 245 is controlled by the layer restriction by ΔV and the restricting blade and other known technology and, for example, set to 6 μm to 15 μm.

Figure 2:
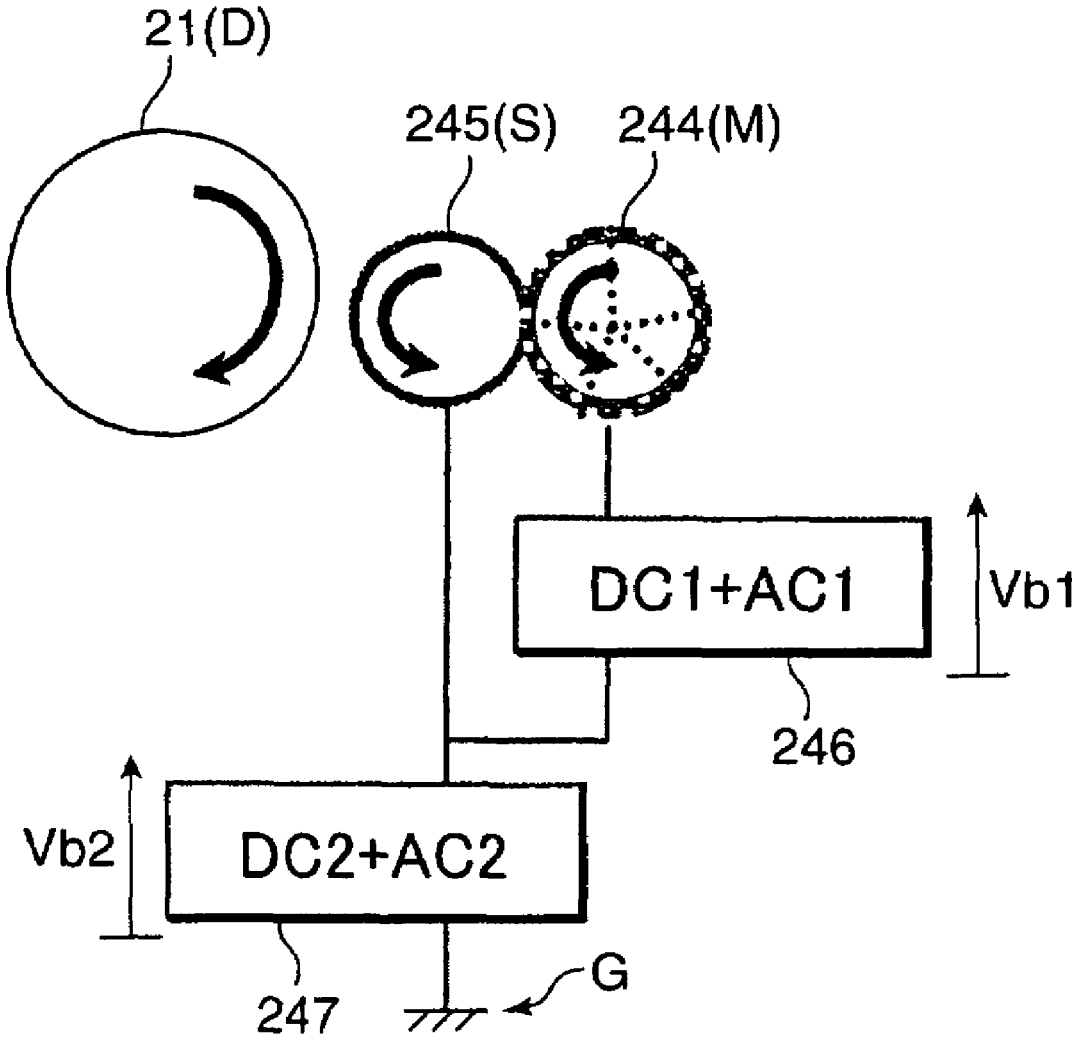
FIG. 2 is a diagram showing a construction for applying bias voltages to a magnetic roller and a developing roller in first to third embodiments.

The above "DC1" denotes a direct-voltage component of a toner supply bias voltage applied to the magnetic roller 244 by the first bias power supply 246, and the above "DC2" denotes a direct-voltage component of a development bias voltage applied to the developing roller 245 by the second bias power supply 247. In the printer 1 of this embodiment, a construction for applying the bias voltages to the magnetic roller 244 and the developing roller 245 differs from the one shown in FIG. 6 and is as shown in FIG. 2.

A bias voltage is applied to the magnetic roller 244 by the first bias power supply 246 (second bias applying device). A bias voltage is applied to the developing roller 245 by the second bias power supply 247 (first bias applying device). A reference potential terminal (negative terminal) of the first bias power supply 246 is connected to an output terminal of the second bias power supply 247.

The first bias power supply 246 is a power supply circuit for applying a bias voltage Vb1 as an alternating voltage component AC1 in the form of a rectangular wave whose duty ratio is set to Duty(mag) superposed a direct voltage component DC1. Duty(mag) is a ratio of T1 to the sum of a period T1 during which a voltage for transferring the toner from the magnetic roller 244 to the developing roller 245 is applied and a period T2 during which a voltage for pulling the toner from the developing roller 245 back to the magnetic roller 244 is applied. In this embodiment, Duty(mag) is, for example, set to 70%.

The second bias power supply 247 is a power supply circuit for applying a bias voltage Vb2 as an alternating voltage component AC2 in the form of a rectangular wave whose duty ratio is set to Duty(slv) superposed a direct voltage component DC2. Duty(slv) is a ratio of T3 to the sum of a period T3 during which a voltage for transferring the toner from the developing roller 245 to the photoconductive drum 21 is applied and a period T4 during which a voltage for pulling the toner from the photoconductive drum 21 back to the developing roller 245 is applied. In this embodiment, Duty(slv) is, for example, set to 30%.

In this way, the first bias power supply 246 for applying the bias voltage to the magnetic roller 244 is connected to a ground common to the second bias power supply 247 via the second bias power supply 247 for applying the bias voltage to the developing roller 245. An employed circuit construction (wiring) is such that the ground of the first bias power supply 246 and that of the second bias power supply 247 are a common (one) ground.

Then, the second bias power supply 247 and the first bias power supply 246 are connected in series, wherefore the bias voltage Vb2 outputted from the second bias power supply 247 and the bias voltage Vb1 outputted from the first bias power supply 246 are added and applied to the magnetic roller 244. At this time, the voltage applied between the magnetic roller and the developing roller is equal to the bias voltage Vb1 outputted from the first bias power supply 246.

Figure 6:
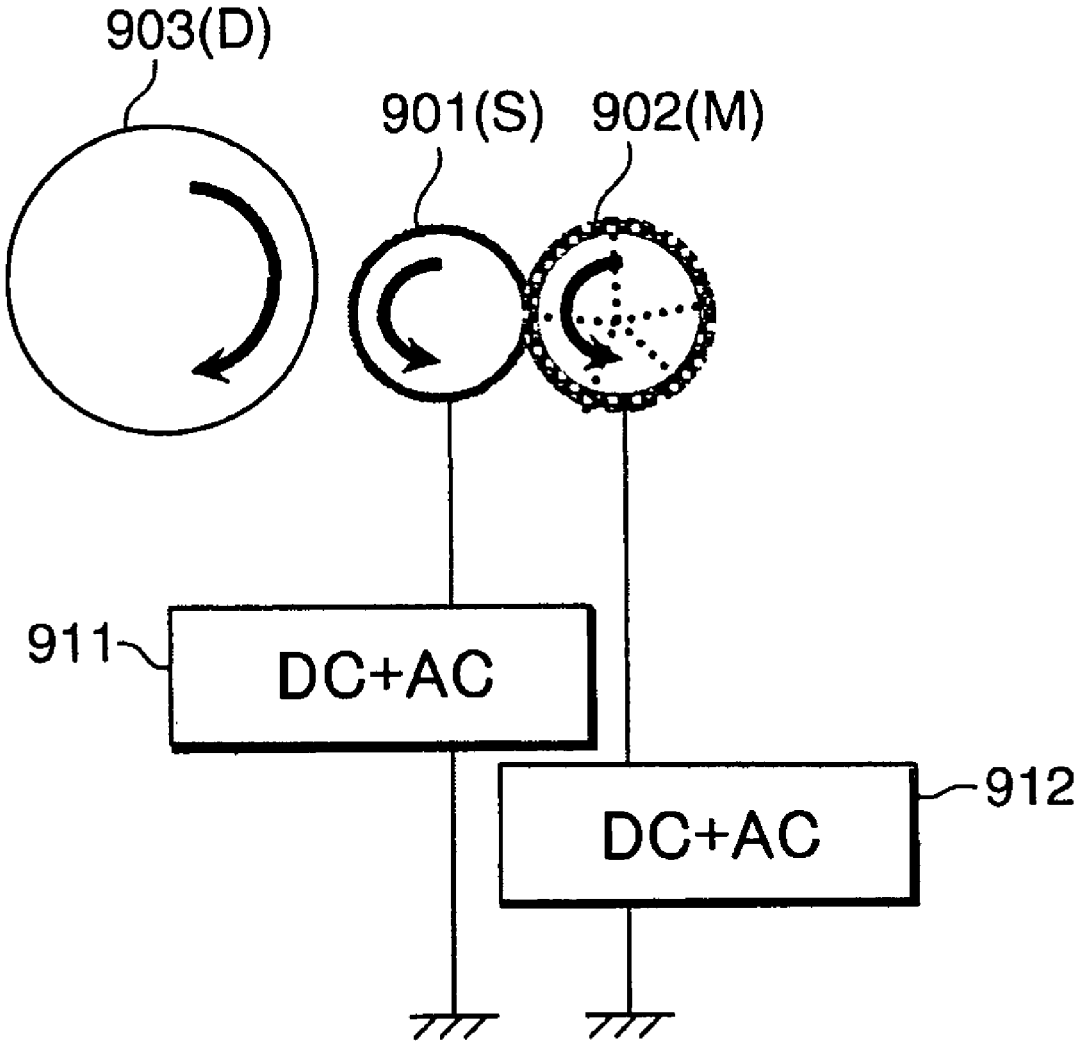
PRIOR ART FIG.6
FIG. 6 is a diagram showing a conventional construction for applying bias voltages to a magnetic roller and a developing roller.

In the case of the conventional construction shown in FIG. 6, the alternating-current (AC) components of the first and second bias power supplies 911, 912 are respectively applied to the developing roller 901 and the magnetic roller 902 in parallel, so to speak. Thus, the voltage between the magnetic roller 902 and the developing roller 901 is a difference between the output of the first bias power supply 911 and that of the second bias power supply 912.

Accordingly, the voltage between the magnetic roller 902 and the developing roller 901 cannot be set unless both the output voltage of the first bias power supply 911 and that of the second bias power supply 912 are controlled. On the other hand, the output voltage of the first bias power supply 911 is related to an alternating bias voltage between the photoconductive drum and the developing roller and influences toner releasability from the developing roller 245 and toner developability on the photoconductive drum 21. Thus, it is difficult to set the alternating bias voltage (AC voltage) between the magnetic roller and the developing roller and an alternating bias voltage between the photoconductive drum and the developing roller to such voltage values as to optimize the respective effects. Therefore, it has been necessary to regulate (balance) the voltage values by reducing either one of the effects.

However, in the case shown in FIG. 2, the first bias power supply 246 is connected with the ground common to the second bias power supply 247 via the second bias power supply 247. Thus, the bias voltage Vb1 is superimposed on the bias voltage Vb2 applied to the developing roller 245 as a basis, whereby the superimposed bias voltage Vb1+Vb2 is applied to the magnetic roller 244.

As a result, the bias voltage Vb2 is canceled out between the developing roller 245 and the magnetic roller 244, and the output voltage of the first bias power supply 246 becomes the voltage between the magnetic roller and the developing roller. Therefore, the alternating bias voltage between the magnetic roller and the developing roller and the one between the photoconductive drum and the developing roller can be easily individually regulated. In other words, alternating bias voltages having different cycles, phases, Vpp, frequencies, etc. (direct voltages (Vdc) to be described later, alternating voltages (Vpp), frequencies (f), duty ratios and the like) can be applied between the magnetic roller and the developing roller and between the photoconductive drum and the developing roller.

The thin toner layer on the developing roller 245 changes depending on the resistance of the developer, a difference between the rotational speed of the developing roller 245 and that of the magnetic roller 244 and the like, but it can be also controlled by the above potential difference ΔV. The toner layer on the developing roller 245 becomes thicker as ΔV increases while becoming thinner as ΔV decreases. A suitable range for ΔV of the magnetic roller 244 and the developing roller 245 is generally from 100 V to about 350 V.

The charged toner is held in the form of a thin layer on the developing roller 245 with a thickness corresponding to the potential difference ΔV between the magnetic roller 244 and the developing roller 245. By applying a bias voltage, in which a direct voltage and an alternating voltage are superimposed, between the developing roller 245 and the photoconductive drum 21, the toner transfers from the developing roller 245 to the photoconductive drum 21 to develop an electrostatic latent image on the photoconductive drum 21. In order to prevent the scattering of the toner, the alternating voltage is applied immediately before image development.

The development residual toner on the developing roller 245 is easily collected and replaced by a brush effect brought about by the contact of the magnetic brush on the magnetic roller with the toner layer on the developing roller 245 and a circumferential speed difference between these rollers and an electric field between the developing roller 245 and the magnetic roller 244 without providing a special device such as a scraping blade.

At this time, the width of the magnetic brush is the width of a collection range for collecting the toner on the developing roller 245. Thus, by setting the width of the developing roller 245 shorter than that of the magnetic brush, an area on the outer surface of the developing roller 245 where the development residual toner cannot be collected can be reliably eliminated. Thus, no toner adheres to a developing roller sleeve (not shown) outside the area of the magnetic brush, whereby toner scattering at the opposite ends of the developing roller 245 can be eliminated (reduced).

By setting the rotational speed of the magnetic roller 244, for example, to 1.0 to 2.0 times as high as that of the developing roller 245 to collect the toner on the developing roller 245 and supply the developer set to a proper toner density to the developing roller 245, it becomes possible to form a uniform toner layer.

In order to maintain a uniform image density, it is effective to collect the toner on the developing roller 245 to the magnetic roller 244 without straining the toner by eliminating the potential difference ΔV between the magnetic roller 244 and the developing roller 245 during a time except at a development timing.

In the case of using the above a-Si photoconductor as a photoconductive material of the photoconductive drum 21, there is a feature that a potential after the exposure of the outer surface of the photoconductive drum 21 is a very low potential equal to or below 20 V. If the thickness of the a-Si photoconductive layer is thinned, a saturation charge potential decreases and a withstand voltage decreases to cause a dielectric breakdown. On the other hand, if the thickness of the a-Si photoconductive layer is thickened, there is a tendency that an electric charge density on the outer surface of the photoconductive drum 21 increases when a latent image is formed, thereby improving development performances.

This tendency is particularly notable in an a-Si photoconductor having a dielectric constant of as high as about 10 when the layer thickness is 25 μm or smaller, more preferably 20 μm or smaller. In this case, image development is possible with such a development bias voltage in which the direct voltage component DC2 is set to or below 150 V, a peak-to-peak voltage Vpp as the alternating voltage component AC2 is set to 200 V to 2000 V and the frequency thereof is set to 1 to 4 kHz.

An organic photoconductor (OPC) has been conventionally known as a photoconductor used in image forming apparatuses. If a positively charged organic photoconductor (OPC) is used as the photoconductive drum 21, it is important to set the thickness of a photoconductive layer to 25 μm or larger and increase an added amount of a charge generating material in order to set a residual potential to 100 V or less. Particularly, an OPC having a single layer structure is advantageous since the electric charge generating material is added in the photoconductive layer and, hence, sensitivity changes a little even if the thickness of the photoconductive layer decreases.

Even in this case, the direct voltage component DC2 of the development bias voltage is preferably set to 400 V or smaller, more preferably 300 V or smaller to prevent the action of a strong electric field on the toner. Further, it is preferable in light of preventing leakage to set DC2, Vpp to such an extent that a potential difference from the photoconductor does not exceed 1500 V.

Figure 7A:
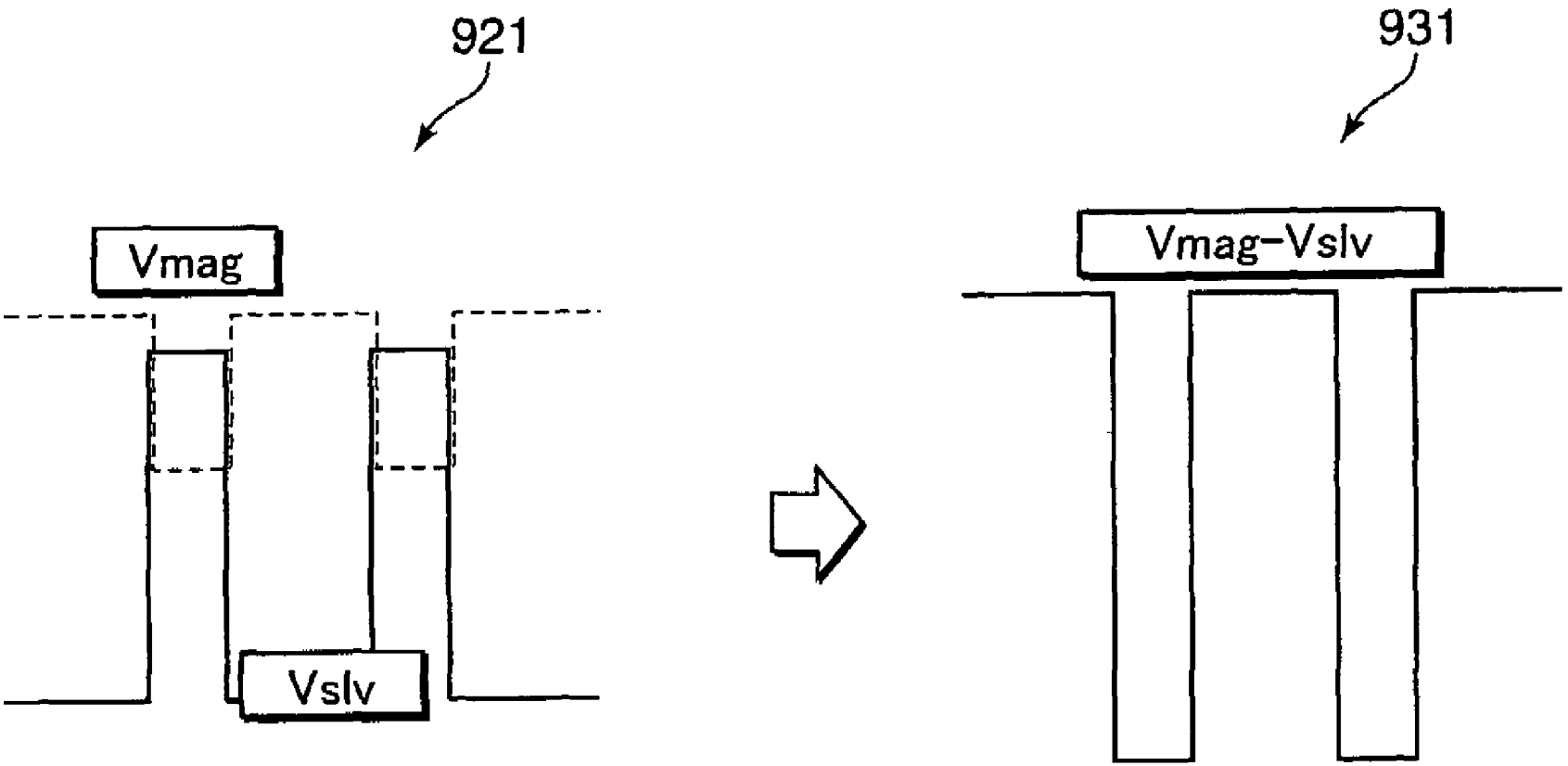
FIG. 7A is a diagram showing a bias voltage Vslv applied to the developing roller, a bias voltage Vmag applied to the magnetic roller and a voltage (Vmag−Vslv) between the magnetic roller and the developing roller in the conventional construction.

Here, the bias voltages to the developing roller 245 and the magnetic roller 244 and duty ratios are described. FIG. 7A is a diagram showing the waveforms of the bias voltages Vslv, Vmag applied to the developing roller and the magnetic roller and that of a combined bias voltage of the bias voltages Vslv, Vmag between the magnetic roller and the developing roller in the conventional construction.

A waveform 921 shown in FIG. 7A indicates the bias voltage Vslv by solid line and the bias voltage Vmag by broken line. A waveform 931 shown in FIG. 7A indicates a voltage between the magnetic roller and the developing roller (combined bias voltage) generated by the bias voltages Vslv, Vmag.

Figure 7B:
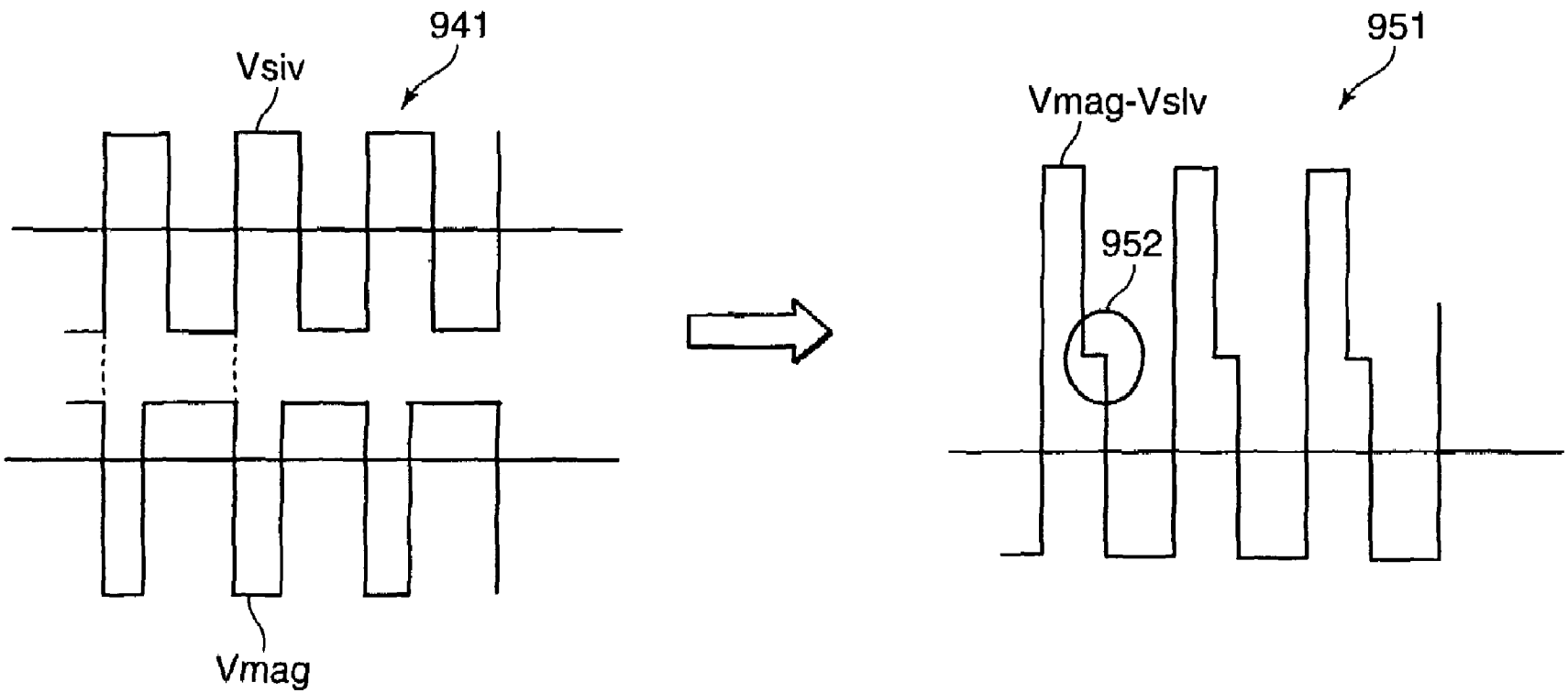
FIG. 7B is a diagram showing the bias voltage Vslv, the bias voltage Vmag and the voltage (Vmag−Vslv) between the magnetic roller and the developing roller in the case where the total of duty ratios of the bias voltages Vslv, Vmag falls below 100% in the conventional construction.

If an alternating-current bias having the same cycle and frequency as and a phase opposite to an alternating-current bias to be applied to the developing roller is applied to the magnetic roller in the case of the conventional power supply connecting construction shown in FIG. 6, the potential difference between the magnetic roller and the developing roller is represented by a waveform as shown by 951 in FIG. 7B if duty ratio (slv)≠100−duty ratio (mag) as shown by a waveform 941 of FIG. 7B. In other words, a potential between a maximum bias voltage (Vmax) and a minimum bias voltage (Vmin) of the bias voltages Vslv, Vmag shown in the waveform 941 appears between the magnetic roller and the developing roller.

Then, the voltage between the magnetic roller and the developing roller is represented by a stepwise voltage waveform as shown by 952, thereby reducing an effect of transferring and pulling back the toner.

Duty ratio (slv) and duty ratio (mag) respectively indicate the duty ratios for the developing roller and the magnetic roller.

Accordingly, if a voltage as shown by 931 in FIG. 7A is applied between the magnetic roller and the developing roller, the duty ratio of the bias voltage Vslv needs to be set in accordance with the voltage between the magnetic roller and the developing roller. Thus, a time for forming the thin toner layer on the developing roller based on the bias voltage Vslv becomes shorter and a time for collecting the toner unused for image development from the developing roller also becomes shorter, with the result that efficiency becomes poor.

Since the bias voltage applied between the magnetic roller and the developing roller is substantially equal to the bias voltage Vb1 applied to the magnetic roller in this embodiment of the present invention, the time for forming the thin toner layer on the developing roller and the time for collecting the toner unused for image development from the developing roller depend only on the bias voltage Vb1 applied to the magnetic roller.

Here, if duty ratio (slv)=100(%)−duty ratio (mag) in the conventional construction shown in FIG. 6, the combined waveform between the magnetic roller and the developing roller appears as a sum of the absolute value of Vmag and that of Vslv as shown in FIG. 7A and an electric field by this voltage acts as a force to transfer the toner. On the contrary, in the construction of this embodiment shown in FIG. 2, the bias voltage applied between the magnetic roller and the developing roller is the output voltage of the first bias power supply 246.

Accordingly, if the output voltage of the first bias power supply 246 should be set equal to the bias voltage Vmag in FIG. 6 in the construction shown in FIG. 2, an electric field for transferring the toner weakens. Thus, in this embodiment shown in FIG. 2, Vpp (peak-to-peak voltage) of the output voltage of the bias voltage Vb1 outputted from the first bias power supply 246 needs to be larger than the bias voltage Vmag in FIG. 6.

In the first embodiment, the printer 1 was constructed (set) to satisfy the following conditions (development conditions). Specifically, an a-Si drum made of the above a-Si photoconductor was used as the photoconductive drum 21; the outer diameter of the photoconductive drum 21 (photoconductive drum diameter) was set to 30 mm, that of the developing roller 245 (developing roller diameter) to 20 mm and that of the magnetic roller 244 (magnetic roller diameter) to 25 mm. The circumferential speeds of these were as follows.

| | |
|---|---|
| Photoconductive drum 21: | 300 mm/sec |
| Developing roller: | 450 mm/sec |
| Magnetic roller: | 675 mm/sec. |

The developing roller 245 used had the outer surface thereof made of an aluminum base material, and the outer surface of the aluminum base material was coated with a silicon modified urethane resin such that the coating had a specified thickness. Here, this coating thickness was set to 0.8 μm. A gap (spacing) between the magnetic roller 244 and the developing roller 245 was 350 μm. Bias voltages applied to the magnetic roller 244 and the developing roller 245 were as follows.

Developing roller applied bias voltage Vb2: direct voltage Vdc2 (DC2)=300V, alternating voltage (AC2) Vpp=1.6 kV, frequency f=2.7 kHz, duty ratio=30%

Magnetic roller applied bias voltage Vb1: direct voltage Vdc1 (DC1)=300V, alternating voltage (AC1) (having the same cycle as and a phase opposite to the one applied to the developing roller 245) Vpp=2.8 kV, frequency f=2.7 kHz, duty ratio=70%

Toner: volume average particle diameter=6.5 μm, CV value of number distribution=23.5%

Carrier: weight average particle diameter=45 μm, saturation magnetization=65 emu/g The above saturation magnetization was obtained by a measurement in a magnetic field of 79.6 kA/m (1 kOe) using "VSM-P7" manufactured by Toei Industry Co., Ltd. Further, the volume average particle diameter of the toner and the CV value in the number distribution of the volume average particle diameter of the toner were obtained by a measurement at an aperture diameter of 100 μm (measurement range of 2.0 μm to 60 μm) using a Multicizer III manufactured by Beckman Coulter, Inc.

The CV (coefficient of variation) value is an index indicating the uniformity of particle diameters (diameters) of particle products (sharpness of a particle diameter distribution) and is a ratio of a standard deviation to an average particle diameter. The larger the CV value, the broader the particle diameter distribution. The smaller the CV value, the sharper the particle diameter distribution. Here, the CV value in the number distribution of the particle diameters of the toner is a value obtained by dividing the standard deviation of the toner particle diameters by the average particle diameter of the toner.

When a thin toner layer was formed on the developing roller 245 by operating the printer 1 constructed to satisfy the above conditions (development conditions), the thickness of the thin toner layer on the developing roller 245 was 12.5 μm. This thin toner layer thickness was measured using a LASER SCAN DIAMETER LS-3100 manufactured by Keyence Corporation. Specifically, the developing roller diameter having the thin toner layer formed thereon and the developing roller diameter having no thin toner layer formed thereon were measured and the thin toner layer thickness was calculated by subtracting the latter diameter from the former one.

Figure 3:
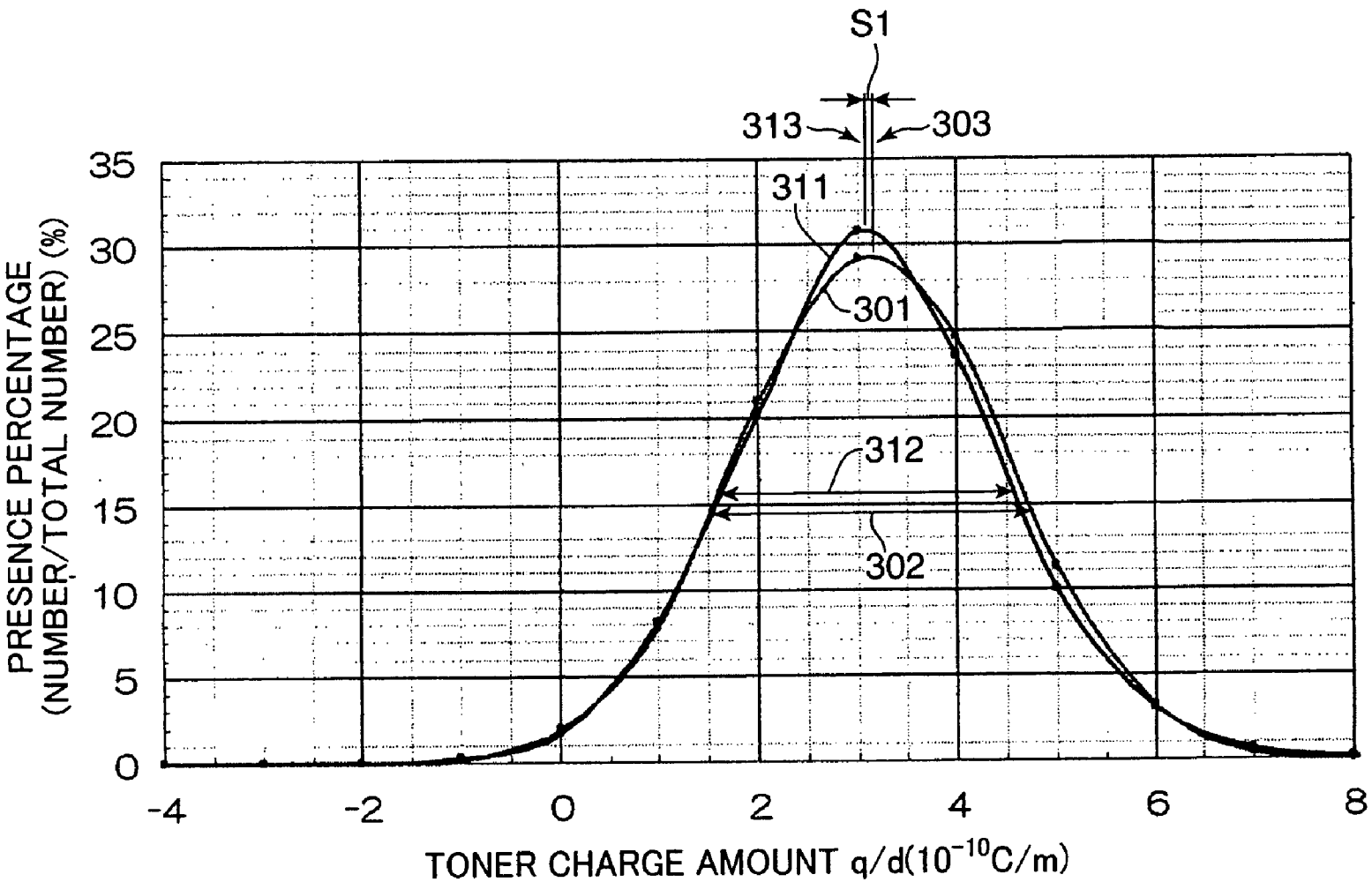
FIG. 3 is a graph showing toner charge number distributions on the developing roller and the magnetic roller in the first embodiment.

At this time, as shown in FIG. 3, a half width 302 was 3.2 ($10^{-10}$ C/m) and a peak position 303 was 3.2 ($10^{-10}$ C/m) in a charge number distribution 301 of the toner in the thin toner layer on the developing roller 245, whereas a half width 312 was 3.1 ($10^{-10}$ C/m) and a peak position 313 was 3.1 ($10^{-10}$ C/m) in a charge number distribution 311 of the toner in the two-component developer on the magnetic roller 244.

Specifically, a difference between the two half widths (half width difference) was 0.1 ($10^{-10}$ C/m) and a difference between the peak positions (peak position difference S1) was 0.1 ($10^{-10}$ C/m). It should be noted that the half width is the width of the distribution when the peak height of the charge number distribution of toner is halved.

The charge number distribution of toner was measured using an E-SPART ANALYZER MODEL EST-3 manufactured by Hosokawa Micron Corporation. Specifically, about 1 g of the two-component developer is collected from the developing roller 245 or the developing device 24 and placed on a magnet of 90 mT. The developer from the developing device 24 or the one on the developing roller 245 is arranged at a measurement position (position to be blown by air). The toner is arranged at a position to be blown by the air. In this way, the two-component developer and the toner are respectively measured.

At this time, setting was such that air pressure=0.55 to 0.8 kgf/cm$^2$ (=0.055 to 0.08 Mpa), PM VOLTAGE=−0.5 kV, and FILDE VOLTAGE=0.050 kV.

Thus, in the first embodiment, it was empirically found out that, in the case of the positively charged toner as described above, the selective transfer of the toner was suppressed by coating the outer surface of the developing roller 245 with the silicon modified urethane resin, with the result that the variation of the toner particle diameter distribution in the two-component developer became smaller and it could be realized to set the half width difference of the charge number distribution of toner to 0.8 ($10^{-10}$ C/m) or smaller or to set the half width difference to 0.8 ($10^{-10}$ C/m) or smaller and the peak position difference to 1.0 ($10^{-10}$ C/m) or smaller.

Since this silicon modified urethane resin includes an urethane resin component having the same charging polarity as the positively charged toner, there is no likelihood of generating negative electric charges due to friction with the magnetic brush carried on the magnetic roller 244 or the toner carried on the urethane resin. Therefore, there is no likelihood of increasing the charge amount of the toner carried on the silicon modified urethane resin and, hence, no likelihood of increasing electric adherence.

Since releasability by the silicon component also acts, toner developability from the developing roller 245 is significantly increased. Accordingly, by setting the thickness of the toner layer formed on the developing roller 245 to 6 to 15 μm and decreasing the amount of the toner to be transferred, the toner residual on the developing roller 245 after image development is extremely reduced by the effect of the silicon modified urethane resin. Thus, an increase in the charge amount of the toner accumulated on the developing roller 245 is suppressed and the variation of the toner charge number distribution on the developing roller 245 is reduced, with the result that the thin toner layer is stably formed. Therefore, it becomes possible to prevent the toner charge number distribution on the developing roller 245 and that on the magnetic roller 244 from varying.

Second Embodiment

In a second embodiment, the above printer 1 was constructed (set) to satisfy the following conditions (development conditions). Specifically, an a-Si drum made of the above a-Si photoconductor was used as the photoconductive drum 21; the photoconductive drum diameter was set to 30 mm, the developing roller diameter to 20 mm and the magnetic roller diameter to 25 mm.

The circumferential speeds of these were as follows.

| | |
|---|---|
| Photoconductive drum 21: | 300 mm/sec |
| Developing roller: | 450 mm/sec |
| Magnetic roller: | 675 mm/sec. |

The developing roller 245 used had the outer surface thereof made of an aluminum base material and had an alumite processing applied to the outer surface of the aluminum base material (coated with the silicon modified urethane resin in the first embodiment). A gap (spacing) between the magnetic roller 244 and the developing roller 245 was 350 μm.

Figure 8:
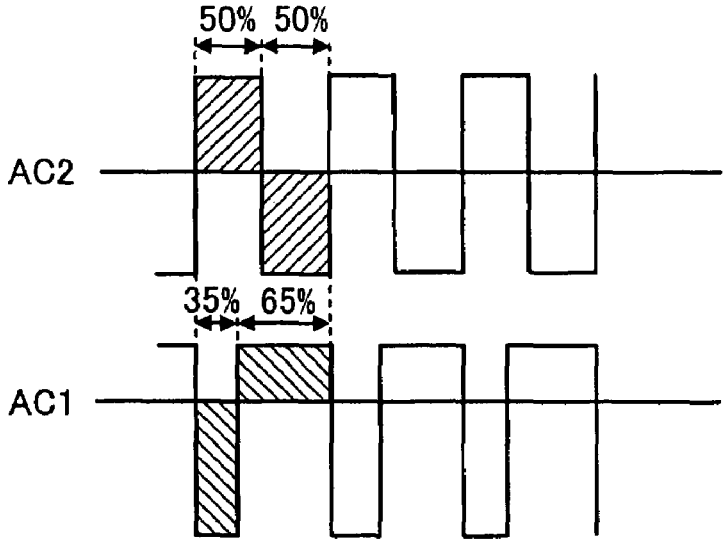
FIG. 8 is a waveform chart of alternating voltages (AC1), (AC2) in the second embodiment.

Bias voltages applied to the magnetic roller 244 and the developing roller 245 were as follows. Further, the waveforms of alternating voltages (AC1), (AC2) are shown in FIG. 8.

Developing roller applied bias voltage Vb2: direct voltage Vdc2 (DC2)=300 V, alternating voltage (AC2) Vpp=1.6 kV, frequency f=2.7 kHz, duty ratio=50% (30% in the first embodiment)

Magnetic roller applied bias voltage Vb1: direct voltage Vdc1 (DC1)=400 V, alternating voltage (AC1) (having the same cycle as and a phase opposite to the one applied to the developing roller 245) Vpp=2.8 kV, frequency f=2.7 kHz, duty ratio=65% (70% in the first embodiment)

Toner: volume average particle diameter=6.5 μm, CV value of number distribution=23.5%

Carrier: weight average particle diameter=45 μm, saturation magnetization=65 emu/g Similar to the first embodiment, the above saturation magnetization was obtained by a measurement in a magnetic field of 79.6 kA/m (1 kOe) using the "VSM-P7" manufactured by Toei Industry Co., Ltd. Further, the volume average particle diameter of the toner and the CV value in the number distribution of the volume average particle diameter of the toner were obtained by a measurement at an aperture diameter of 100 μm (measurement range of 2.0 μm to 60 μm) using the Multicizer III manufactured by Beckman Coulter, Inc.

When a thin toner layer was formed on the developing roller 245 by operating the printer 1 constructed to satisfy these development conditions, the thickness of the thin toner layer on the developing roller 245 was 14.5 μm (12.5 μm in the first embodiment). This thin toner layer thickness was measured using the LASER SCAN DIAMETER LS-3100 manufactured by Keyence Corporation. As in the first embodiment, the thin toner layer thickness was calculated by subtracting the developing roller diameter having no thin toner layer formed thereon from the developing roller diameter having the thin toner layer formed thereon.

Figure 4:
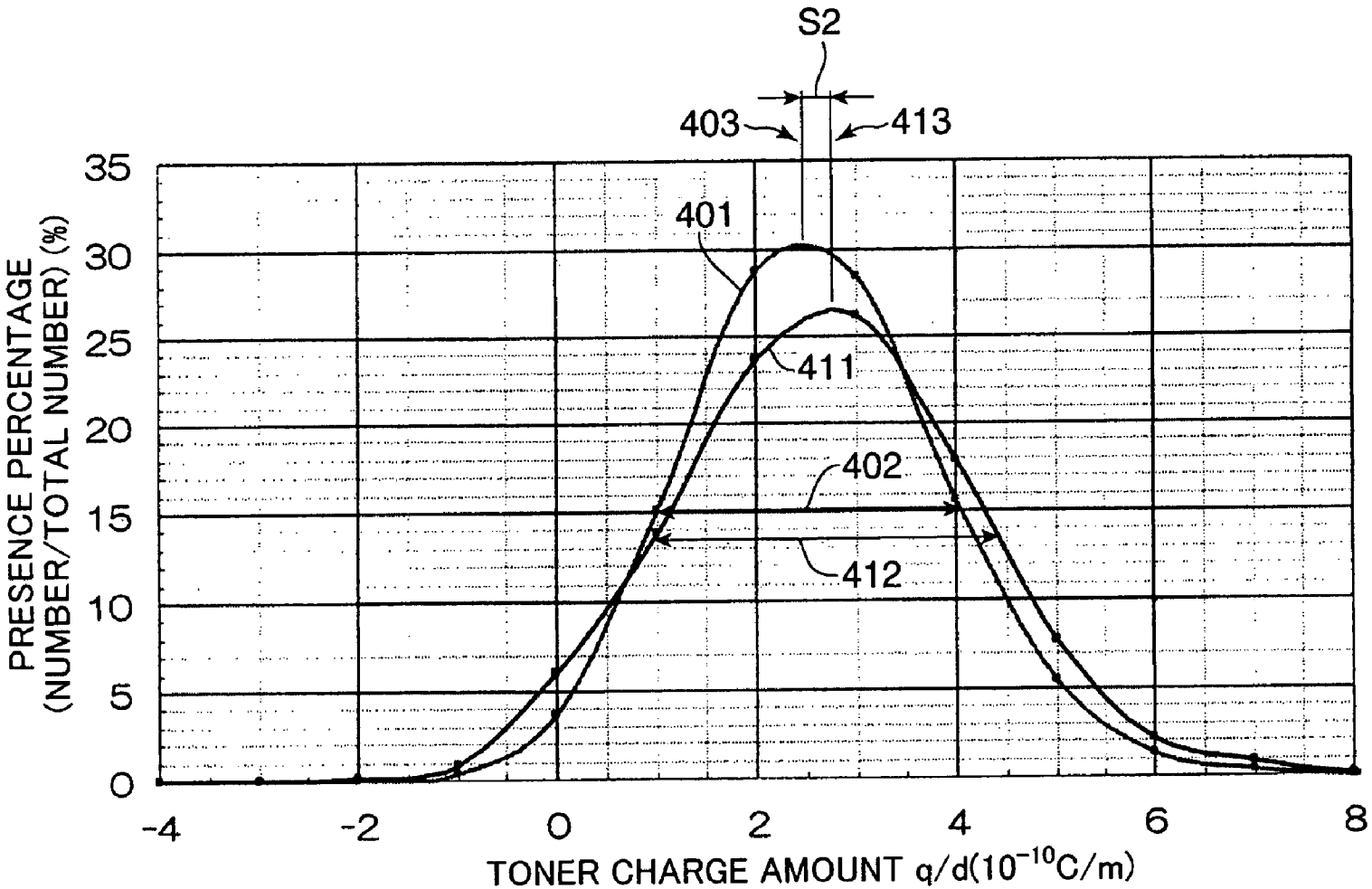
FIG. 4 is a graph showing toner charge number distributions on the developing roller and the magnetic roller in the second embodiment.

At this time, as shown in FIG. 4, a half width 402 was 3.0 ($10^{-10}$ C/m) and a peak position 403 was 2.4 ($10^{-10}$ C/m) in a charge number distribution 401 of the toner in the thin toner layer on the developing roller 245, whereas a half width 412 was 3.5 ($10^{-10}$ C/m) and a peak position 413 was 2.8 ($10^{-10}$ C/m) in a charge number distribution 411 of the toner in the two-component developer on the magnetic roller 244. Specifically, a difference between the two half widths (half width difference) was 0.5 ($10^{-10}$ C/m) and a difference between the peak positions (peak position difference S2) was 0.4 ($10^{-10}$ C/m).

Thus, in the second embodiment, if Duty(mag) denotes the duty ratio (65%) of the alternating bias voltage (alternating voltage) applied to the magnetic roller 244, i.e. to the two-component developer and Duty(slv) denotes the duty ratio (50%) of the alternating bias voltage applied to the developing roller 245, a bias condition suitable for the formation of the thin toner layer on the developing roller 245 by the toner transferred from the magnetic roller 244 and a bias condition suitable for the formation of a toner image on the photoconductive drum 21 by the toner transferred from the developing roller 245 could be accomplished by setting 100(%)−Duty (mag)<Duty(slv) (100−65<50).

In this way, it was empirically found out that the selective transfer of the toner was suppressed and it could be realized to set the half width difference of the charge number distribution of toner to 0.8 ($10^{-10}$ C/m) or smaller or to set the half width difference to 0.8 ($10^{-10}$ C/m) or smaller and the peak position difference to 1.0 ($10^{-10}$ C/m) or smaller.

Third Embodiment

Figure 9:
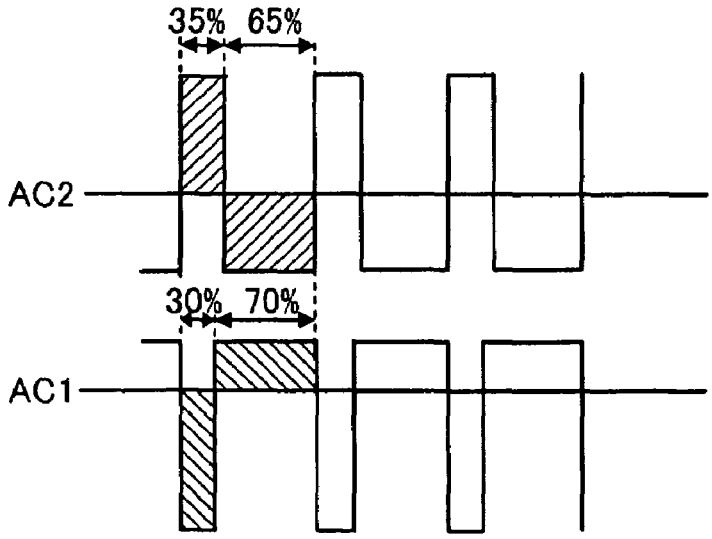
FIG. 9 is a waveform chart of alternating voltages (AC1), (AC2) in the third embodiment.

Although Duty(slv)=50% and Duty(mag)=65% in the second embodiment, the setting is not limited thereto and any setting to satisfy the above condition, i.e. 100(%)−Duty(mag) <Duty(slv), can be made. For example, the setting may be such that Duty(slv)=35% and Duty(mag)=70%. The waveforms of the alternating voltages (AC1), (AC2) in this case are shown in FIG. 9.

In this case as well, it was empirically found that the half width difference of the charge number distribution of toner could be set to 0.8 ($10^{-10}$ C/m) or smaller or that the half width difference and the peak position difference could be respectively set to 0.8 ($10^{-10}$ C/m) or smaller and 1.0 ($10^{-10}$ C/m) or smaller.

Results in the case of forming images on sheets using the image forming apparatuses according to these first to third embodiments are summarized in a table shown in FIG. 5. FIG. 5 shows experimental results obtained for the first to third embodiments as Examples 1 to 3. Other examples according to the present invention are shown as Examples 4 to 8. In this table are also shown Comparative Examples 1 to 4 according to prior arts. Specific evaluation methods for image nonuniformity evaluation index A, image density ID and ghost in FIG. 5 are described later.

As shown in FIG. 5, the image nonuniformity evaluation index A was obtained after 10000 images with a coverage rate of 6% were printed under the conditions in the above first to third embodiments. The larger the image nonuniformity evaluation index A, the larger the image nonuniformity. In FIG. 5, the image nonuniformity evaluation indices A exceeding 0.15 are shown in parentheses.

As shown in FIG. 5, A=0.115, 0.120, 0.145 (A≦0.15) in Examples 1 to 3 according to the present invention. In the other Examples 4 to 8, satisfactory results were obtained with the image nonuniformity evaluation index A smaller than 0.15.

On the other hand, in Comparative Examples 1, 2 and 4 as prior arts, the image nonuniformity evaluation index A exceeds 0.15. Thus, it could be confirmed that image nonuniformity could be reduced by satisfying the conditions of Examples 1 to 8 according to the present invention.

The image density ID as an evaluation index for the evaluation of the image density was obtained after making 1000 prints. The larger the image density ID, the better the image density. In FIG. 5, the image densities ID exceeding 1.30 are shown in parentheses.

As shown in FIG. 5, the value of the image density ID in any of Examples 1 to 8 according to the present invention was larger than those in Comparative Examples 1 to 3 as prior arts. Thus, it could be confirmed that the image density could be better maintained after repeating the printing operation than in the image forming apparatus according to the prior arts by satisfying the conditions of Examples 1 to 8 according to the present invention.

Ghost appearing as a residual image of a part of a developed image during the next image development was evaluated by the eyes. As a result, as shown in FIG. 5, good results were obtained in Examples 1, 2, 4 to 6 according to the present invention, and satisfactory results were obtained in Examples 3, 7 and 8. On the other hand, no satisfactory results were obtained for ghost in Comparative Examples 1, 2 and 4 as prior arts.

As described above, in Examples 1 to 8 according to the present invention, it was confirmed that the occurrences of image nonuniformity and ghost images could be stably reduced over a long term and high quality images were obtained. On the other hand, none of Comparative Examples 1 to 4 as prior arts satisfies all the conditions of the image nonuniformity evaluation index A of 0.15 or smaller, the image density ID of 1.30 or larger and the ghost evaluation of good or satisfactory.

In any of Examples 1 to 8 according to the present invention, the thin toner layer thickness was a value in the range of 6 μm to 15 μm (thin toner layer thickness was 15 μm or larger in the conventional cases shown in Comparative Examples 1 to 4). Here, it is desirable to maximally reduce this thin toner layer thickness. By reducing the thin toner layer thickness, the toner on the developing roller 245 can be entirely (as much as possible) used for image development, whereby problems such as image density defects and fogging caused by the return of the development residual toner on the developing roller 245 to the photoconductive drum 21 and the like can be prevented from occurring.

Further, any of Examples 1 to 8 according to the present invention shown in FIG. 5 satisfies the condition that the half width difference of the toner charge number distributions is 0.8 ($10^{-10}$ C/m) or smaller and the condition that the peak position difference is 1.0 ($10^{-10}$ C/m) or smaller.

This indicates a small difference (deviation) between the charge number distribution of toner in the thin toner layer on the developing roller 245 and that of toner in the two-component developer on the magnetic roller 244 as shown in FIGS. 3 and 4. The case shown in FIG. 3, in which the difference in the toner charge number distribution is smaller to have a higher degree of coincidence, is more preferable than the case shown in FIG. 4.

If the value of the half width difference is small or the values of the half width difference and the peak position difference are small as described above, the difference between the charge number distribution (301, 401) of toner in the thin toner layer on the developing roller 245 and that (311, 411) of toner in the two-component developer on the magnetic roller 244 is also small. Thus, the selectivity of the toner transfer between the magnetic roller 244 and the developing roller 245 (or between the developing roller 245 and the photoconductive drum 21) can be reduced, wherefore the occurrence of image density defects (nonuniformity) and the like can be prevented.

This can be rephrased as follows. No deviations of the half widths and the peak positions of the respective toner charge number distributions mean no occurrence of the selective transfer of toner particles that are easily charged and transferred and further mean the suppression of so-called charge-up of the toner between the developing roller and the magnetic roller or on the developing roller.

Although Duty(slv) is 50, 65% and Duty(mag) is 35, 70% in the second and third embodiments (Examples 2, 3 in the table) (the duty ratios of 30, 70% in Example 1 are conventionally general values), Duty(slv), Duty(mag) are preferably in the range of 35 to 65% and in the range of 40 to 70%, respectively. However, the condition of 100(%)−Duty(mag) <Duty(slv) has to be satisfied.

By setting the Duty(slv) of the alternating bias voltage applied to the developing roller 245 to 35 to 65% in this way, it is possible to develop a latent image to such an extent that the remaining amount of the toner in a part of the thin toner layer formed on the developing roller 245 corresponding to the latent image is almost null. Further, by setting the Duty (mag) of the alternating bias voltage applied to the magnetic roller 244 to 40 to 70% and increasing the peak-to-peak voltage Vpp of this alternating bias voltage without causing any leakage between the developing roller 245 and the magnetic roller 244, the selective transfer of the toner to the developing roller 245 can be suppressed and the toner on the developing roller 245 unused for image development can be sufficiently returned. Therefore, it becomes possible to obtain a necessary image density over a long term, to suppress the occurrence of image nonuniformity and to suppress the occurrence of ghost phenomenon.

The above image nonuniformity evaluation index A was obtained from luminances Pi at a plurality of positions of the sheet where the image was formed using the following equations (1) to (4). The luminance of solid parts filled with black was Pmax and that of blank parts was Pmin. This luminance was measured using a Dot Analyzer DA-6000 manufactured by Oji Scientific Instruments. In the above first to third embodiments, a halftone image having a tone value of 25% (600 dpi) was formed on a sheet based on an image data scanned at 3000 dpi using a color scanner ES8500 manufactured by Seiko Epson Corporation. The luminance Pi was measured at a plurality of positions of this sheet using the above Dot Analyzer DA-6000.

$$Di = \log[(P\max - Pi)/P\min] \quad (1)$$

$$Da = \frac{1}{N}\sum_{i=1}^{N} Di \quad (2)$$

$$\sigma_D = \sqrt{\frac{1}{N}\sum_{i=1}^{N}(Di - Da)^2} \quad (3)$$

$$A = \sigma_D / Da \quad (4)$$

where Pi: luminance, Di: converted value of luminance into image density.

In the calculation of the image nonuniformity evaluation index A, the luminance data is first converted into density by Equation (1). Upon the conversion into density, relative densities of Pi to Pmax (luminance of blacked-out solid parts) and Pmin (luminance of blank parts) were calculated. The higher the density, the more difficult to see the image density nonuniformity (the more unlikely to appear in luminance). Thus, correction is made by taking a logarithm.

Subsequently, an average value Da of Di is calculated using Equation (2). Then, an average of deviations of Di from the average value Da was calculated as a root mean square deviation $\sigma_D$ to calculate so-called deviation. Then, the image nonuniformity evaluation index A is calculated using Equation (4).

If f(mag), f(slv) respectively denote the frequency of the alternating voltage applied to the two-component developer (magnetic roller 244) by the first bias power supply 246 and the frequency of the alternating bias voltage applied to the developing roller 245 by the second bias power supply 247, the effects brought about by setting the half width difference to or below 0.8 ($10^{-10}$ C/m) and setting the peak position difference to or below 1.0 ($10^{-10}$ C/m) by setting f(mag)>f (slv) and, further, setting f(mag) to or above 2.5 kHz.

Figure 10:
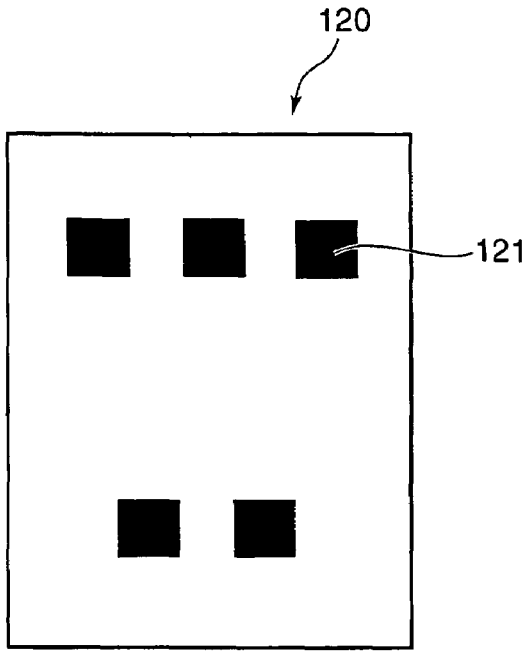
FIG. 10 is a diagram showing an exemplary evaluation image used for the evaluation of image density ID.

The image density ID was calculated as follows. First of all, an evaluation image shown in FIG. 10 was outputted. FIG. 10 shows an example of an evaluation image 120 used for the evaluation of the image density ID. This evaluation image 120 is an image having solid parts 121 at five positions as shown in FIG. 10.

Next, the image densities ID of the solid parts 121 at the five positions were respectively measured and evaluation was made with the following criteria using an average value of the measured image densities as the image density for this evaluation. It should be noted that the image densities ID were measured using a GretagMacbeth portable reflection densitometer RD-19 manufactured by Sakata Inc Corporation.

Figure 11A:
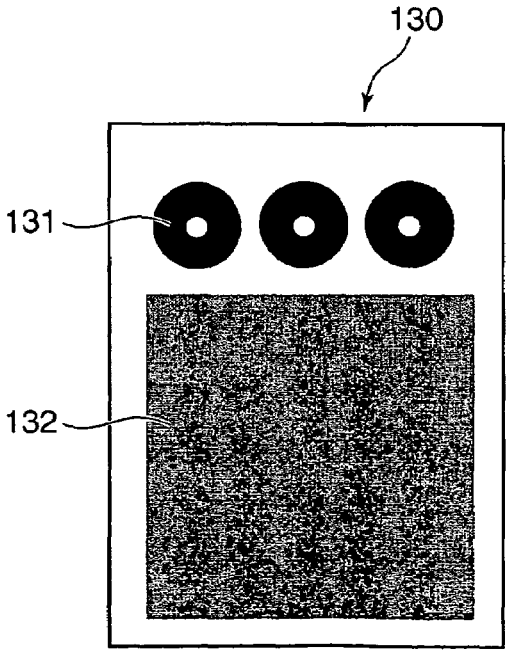
FIG. 11A is a diagram showing an exemplary evaluation image used for ghost evaluation.
Figure 11B:
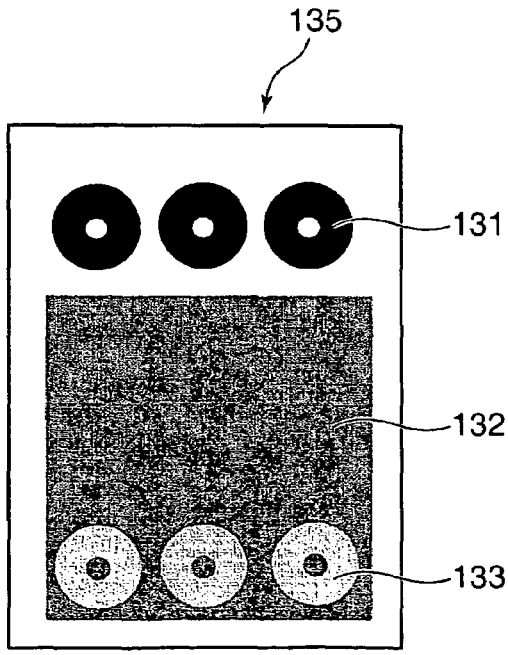
FIG. 11B is a diagram showing an exemplary output image when a ghost occurred.

The ghost was evaluated as follows. First of all, an evaluation image shown in FIG. 11A was outputted. FIGS. 11A and 11B are diagrams showing the ghost evaluation. FIG. 11A shows an example of an evaluation image 130 used for the ghost evaluation, and FIG. 11B shows an example of an output image 135 when a ghost occurred. This evaluation image 130 is an image having solid portions 131 with a tone value of 100% at three positions and a halftone image 132 with a tone value of 10% or 25% at a rear side with respect to a printing direction as shown in FIG. 11A.

Subsequently, it is judged by the eyes whether any ghost (residual image) 133 as shown in FIG. 11B is formed in the halftone image 132 of the output image and evaluation was made with the following criteria.

Good: No ghost 133 is confirmed even the halftone image 132 has a tone value of 10%

Satisfactory: The ghost 133 is slightly confirmed if the halftone image 132 has a tone value of 10%, but no ghost 133 is confirmed if the halftone image 132 has a tone value of 25%.

Impermissible: The ghost 133 is clearly confirmed even if the halftone image 132 has a tone value of 25%.

As described above, the image forming apparatus (printer 1) of the present invention comprises a latent image bearing member for bearing an electrostatic latent image; a toner bearing member opposed to the latent image bearing member and adapted to bear a toner to be conveyed to a development region to develop the electrostatic latent image; a developer bearing member opposed to the toner bearing member and adapted to bear a two-component developer and supply the toner in the two-component developer to the toner bearing member; and a regulator, wherein the thickness of a toner layer carried on the toner bearing member is set to 6 μm to 15 μm and a difference between a half width of a first toner charge number distribution as a number distribution of the charge amount of the toner carried on the toner bearing member and that of a second toner charge number distribution as a number distribution of the charge amount of the toner in the two-component developer carried on the developer bearing member is set to 0.8 ($10^{-10}$ C/m) or smaller by the regulator.

Since the toner layer thickness is set to a small value of 6 μm to 15 μm in this way, the toner on the toner bearing member can be entirely (as much as possible) used for image development or the return of the development residual toner on the toner bearing member to the latent image bearing member (photoconductive drum) can be prevented. Further, since the half width difference is as small as 0.8 ($10^{-10}$ C/m) or smaller, the difference (deviation) between the charge number distribution of the toner in the thin toner layer on the toner bearing member and that of the toner in the two-component developer on the developer bearing member can be reduced (so that the two charge number distributions coincide), and the selectivity of the toner transfer between the toner bearing member and the developer bearing member (or between the developer bearing member and the latent image bearing member) can be reduced. Because of these, stable performances can be maintained over a long term by suppressing image density defects, fogging, toner scattering, ghost phenomenon and the like.

In addition to setting the half width difference of the first and second toner charge number distributions to or below 0.8 ($10^{-10}$ C/m), a difference between the peak positions of the first and second toner charge number distributions is set to 1.0 ($10^{-10}$ C/m) or smaller. Thus, the difference (deviation) between the charge number distribution of the toner in the thin toner layer on the toner bearing member and that of the toner in the two-component developer on the developer bearing member can be further reduced (so that the two charge number distributions coincide), and the selectivity of the toner transfer between the toner bearing member and the developer bearing member (or between the developer bearing member and the latent image bearing member) can be reliably reduced.

Since the regulator includes a silicon modified urethane resin coating the outer surface of the toner bearing member to have a specified thickness, it can be easily realized to set the toner layer thickness to 6 μm to 15 μm, the half width difference to 0.8 ($10^{-10}$ C/m) or smaller or the half width difference and the peak position difference to 0.8 ($10^{-10}$ C/m) or smaller and 1.0 ($10^{-10}$ C/m) or smaller by means of the regulator by a simple construction of coating the silicon modified urethane resin on the toner bearing member.

Further, since the regulator includes a first bias applying device and a second bias applying device for applying an alternating bias voltage to the toner bearing member and applying an alternating bias voltage to the developer bearing member at such duty ratios as to satisfy the condition of 100(%)−Duty(mag)<Duty(slv), it can be easily realized to set the toner layer thickness to 6 μm to 15 μm, to set the half width difference to 0.8 ($10^{-10}$ C/m) or smaller or to set the half width difference and the peak position difference to 0.8 ($10^{-10}$ C/m) or smaller and 1.0 ($10^{-10}$ C/m) or smaller by means of the regulator by a simple construction (method) of applying the alternating bias voltage to the toner bearing member at such a duty ratio as to satisfy the above condition.

Furthermore, since the second bias applying device is connected with the first bias applying device in series and electrically connected to a ground via the first bias applying device, the bias voltage applied to the developer bearing member can be superimposed on the bias voltage applied to the toner bearing member as a basis. As a result, the alternating bias voltages applied to the toner bearing member and the developer bearing member (between the toner bearing member and the developer bearing member or between the toner bearing member and the latent image bearing member), i.e. the above duty ratios can be easily individually regulated.

Specifically, an image forming apparatus according to one aspect of the present invention is the one using a two-component developer containing a toner and a carrier and comprising a latent image bearing member for bearing an electrostatic latent image; a toner bearing member opposed to the latent image bearing member and adapted to bear the toner to be conveyed to a development region to develop the electrostatic latent image; a developer bearing member opposed to the toner bearing member and adapted to bear the two-component developer and supply the toner in the two-component developer to the toner bearing member; and a regulator for setting the thickness of a toner layer carried on the toner bearing member to 6 μm to 15 μm and setting a difference between a half width of a first toner charge number distribution as a number distribution of the charge amount of the toner carried on the toner bearing member and that of a second toner charge number distribution as a number distribution of the charge amount of the toner in the two-component developer carried on the developer bearing member to 0.8 ($10^{-10}$ C/m) or smaller.

According to this construction, the image forming apparatus comprises the latent image bearing member for bearing an electrostatic latent image, the toner bearing member opposed to the latent image bearing member and adapted to bear the toner to be conveyed to a development region to develop the electrostatic latent image, the developer bearing member opposed to the toner bearing member and adapted to bear the two-component developer and supply the toner in the two-component developer to the toner bearing member and the regulator, and the difference between the half width of the first toner charge number distribution as a number distribution of the charge amount of the toner carried on the toner bearing member and that of the second toner charge number distribution as a number distribution of the charge amount of the toner in the two-component developer carried on the developer bearing member is set to 0.8 ($10^{-10}$ C/m) or smaller by the regulator. Further, the thickness of the toner layer carried on the toner bearing member is set to 6 μm to 15 μm.

Since the toner layer thickness is set to a small value of 6 μm to 15 μm, the toner on the toner bearing member can be entirely (as much as possible) used for image development or the return of the development residual toner on the toner bearing member to the latent image bearing member (photoconductive drum) can be prevented. Further, since the half width difference is as small as 0.8 ($10^{-10}$ C/m) or smaller, the difference (deviation) between the charge number distribution of the toner in the thin toner layer on the toner bearing member and that of the toner in the two-component developer on the developer bearing member can be reduced (so that the two charge number distributions coincide), and the selectivity of the toner transfer between the toner bearing member and the developer bearing member (or between the developer bearing member and the latent image bearing member) can be reduced. Because of these, stable performances can be maintained over a long term by suppressing image density defects, fogging, toner scattering, ghost phenomenon and the like.

The regulator preferably sets a difference between the peak positions of the first and second toner charge number distributions to 1.0 ($10^{-10}$ C/m) or smaller.

According to this, since the difference between the peak positions of the first and second toner charge number distributions is set to 1.0 ($10^{-10}$ C/m) or smaller, the difference (deviation) between the charge number distribution of the toner in the thin toner layer on the toner bearing member and that of the toner in the two-component developer on the developer bearing member can be further reduced (so that the two charge number distributions coincide), and the selectivity of the toner transfer between the toner bearing member and the developer bearing member (or between the developer bearing member and the latent image bearing member) can be reliably reduced.

The regulator preferably includes a silicon modified urethane resin coating the outer surface of the toner bearing member to have a specified thickness.

According to this, the silicon modified urethane resin coating the outer surface of the toner bearing member to have the specified thickness is provided as the regulator. Thus, it can be easily realized to set the half width difference and the peak position difference to 0.8 ($10^{-10}$ C/m) or smaller and 1.0 ($10^{-10}$ C/m) or smaller by a simple construction of coating the silicon modified urethane resin on the toner bearing member.

It is preferable that the regulator includes a first bias applying device for applying an alternating bias voltage having a duty ratio Duty(slv) to the toner bearing member and a second bias applying device for applying an alternating bias voltage having a duty ratio Duty(mag) to the developer bearing member; and that the duty ratios Duty(slv), Duty(mag) are set to satisfy a condition of 100(%)−Duty(mag)<Duty(slv).

According to this, since the regulator includes the first and second bias applying devices for applying the alternating-current biases to the toner bearing member and the developer bearing member at such duty ratios as to satisfy the condition of 100(%)−Duty(mag)<Duty(slv), it can be easily realized to set the half width difference to 0.8 ($10^{-10}$ C/m) or smaller or to set the half width difference and the peak position difference to 0.8 ($10^{-10}$ C/m) or smaller and 1.0 ($10^{-10}$ C/m) or smaller by means of the regulator by a simple construction of applying the alternating bias voltage to the toner bearing member at such a duty ratio as to satisfy the above condition.

If f(slv), f(mag) respectively denote the frequency of the alternating voltage outputted by the first bias applying device and the frequency of the alternating bias voltage outputted by the second bias applying device, it is preferable that f(mag) >f(slv) and f(mag)≧2.5 kHz.

According to this, it is possible to obtain the effects brought about by setting the half width difference to 0.8 ($10^{-10}$ C/m) or smaller and the peak position difference to 1.0 ($10^{-10}$ C/m) or smaller.

The second bias applying device is preferably connected with the first bias applying device in series and electrically connected to a ground via the first bias applying device.

According to this, since the second bias applying device is preferably connected with the first bias applying device in series and electrically connected to the ground via the first bias applying device, the bias voltage applied to the developer bearing member can be superimposed on the bias voltage applied to the toner bearing member as a basis. As a result, the alternating bias voltages applied to the toner bearing member and the developer bearing member (between the toner bearing member and the developer bearing member or between the developer bearing member and the latent image bearing member or the toner bearing member and the latent image bearing member) and the above duty ratios can be easily individually regulated.

It is preferable that the regular includes a silicon modified urethane resin to be coated on the outer surface of the toner bearing member, a first bias applying device for applying an alternating bias voltage having a duty ratio Duty(slv) to the toner bearing member and a second bias applying device for applying an alternating bias voltage having a duty ratio Duty (mag) to the developer bearing member; that the second bias applying device is connected with the first bias applying device in series and electrically connected to a ground via the first bias applying device; and that the duty ratios Duty(slv), Duty(mag) are set to satisfy a condition of 100(%)−Duty (mag)<Duty(slv).

According to this, it is possible to set the toner layer thickness to 6 μm to 15 μm, to set the half width difference to 0.8 ($10^{-10}$ C/m) or smaller and to set the peak position difference of the first and second toner charge number distributions to 1.0 ($10^{-10}$ C/m) or smaller. As a result, the difference (deviation) between the charge number distribution of the toner in the thin toner layer on the toner bearing member and that of the toner in the two-component developer on the developer bearing member can be reduced (so that the two charge number distributions coincide), and the selectivity of the toner transfer between the toner bearing member and the developer bearing member (or between the developer bearing member and the latent image bearing member) can be reduced. Because of these, stable performances can be maintained over a long term by suppressing image density defects, fogging, toner scattering, ghost phenomenon and the like.

This application is based on patent application Nos. 2007-168831 and 2008-111694 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus using a two-component developer containing a toner and a carrier, comprising:

a latent image bearing member for bearing an electrostatic latent image;

a toner bearing member opposed to the latent image bearing member and adapted to bear the toner to be conveyed to a development region to develop the electrostatic latent image;

a developer bearing member opposed to the toner bearing member and adapted to bear the two-component developer and supply the toner in the two-component developer to the toner bearing member; and a regulator for setting the thickness of a toner layer carried on the toner bearing member to 6 μm to 15 μm and setting a difference between a half width of a first toner charge number distribution as a number distribution of the charge amount of the toner carried on the toner bearing member and that of a second toner charge number distribution as a number distribution of the charge amount of the toner in the two-component developer carried on the developer bearing member to 0.8 ($10^{-10}$ C/m) or smaller.

2. An image forming apparatus according to claim 1, wherein the regulator sets a difference between the peak positions of the first and second toner charge number distributions to 1.0 ($10^{-10}$ C/m) or smaller.

3. An image forming apparatus according to claim 1, wherein the regulator includes a silicon modified urethane resin coating the outer surface of the toner bearing member to have a specified thickness.

4. An image forming apparatus according to claim 1, wherein:

the regulator includes:

a first bias applying device for applying an alternating bias voltage having a duty ratio Duty(slv) to the toner bearing member, and a second bias applying device for applying an alternating bias voltage having a duty ratio Duty(mag) to the developer bearing member; and the duty ratios Duty(slv), Duty(mag) are set to satisfy a condition of 100(%)−Duty(mag)<Duty(slv).

5. An image forming apparatus according to claim 4, wherein f(mag)>f(slv) and f(mag)≧2.5 kHz if f(slv), f(mag) respectively denote the frequency of the alternating voltage outputted by the first bias applying device and the frequency of the alternating bias voltage outputted by the second bias applying device.

6. An image forming apparatus according to claim 4, wherein the second bias applying device is connected with the first bias applying device in series and electrically connected to a ground via the first bias applying device.

7. An image forming apparatus according to claim 1, wherein:

the regulator includes:

a silicon modified urethane resin to be coated on the outer surface of the toner bearing member, a first bias applying device for applying an alternating bias voltage having a duty ratio Duty(slv) to the toner bearing member, and a second bias applying device for applying an alternating bias voltage having a duty ratio Duty(mag) to the developer bearing member;

the second bias applying device is connected with the first bias applying device in series and electrically connected to a ground via the first bias applying device; and the duty ratios Duty(slv), Duty(mag) are set to satisfy a condition of 100(%)−Duty(mag)<Duty(slv).

* * * * *